United States Patent [19]

Toishi

[11] Patent Number: 4,799,612

[45] Date of Patent: Jan. 24, 1989

[54] FOOT-OPERATED PRESS

[75] Inventor: Yoshiyuki Toishi, Kurobe, Japan

[73] Assignee: Yoshida Kogyo K. K., Tokyo, Japan

[21] Appl. No.: 88,408

[22] Filed: Aug. 24, 1987

[30] Foreign Application Priority Data

Aug. 27, 1986 [JP] Japan ..... 61-13084[U]

[51] Int. Cl.[4] ..... B21J 15/16; B21J 15/28

[52] U.S. Cl. ..... 227/121; 227/129

[58] Field of Search ..... 227/121, 129, 156

[56] References Cited

U.S. PATENT DOCUMENTS 2,049,240 7/1936 Ajouelo et al. ..... 227/121 X 2,127,357 8/1938 Gualtiere ..... 227/121 X 2,229,868 1/1941 Newell Sr. ..... 227/121 X 2,345,476 3/1944 Huelster et al. ..... 227/121 X

*Primary Examiner*—Paul A. Bell

*Attorney, Agent, or Firm*—Hill, Van Santen, Steadman & Simpson

[57] ABSTRACT

A foot-operated press includes a ratchet mechanism operatively connecting a foot pedal and a punch of the press for preventing backward movement of the foot pedal until after the punch has fully been lowered to ensure that a pair of fastener elements can be assembled together in properly clinched condition, with a garment fabric disposed between the two fastener elements.

9 Claims, 5 Drawing Sheets

FOOT-OPERATED PRESS

BACKGROUND OF THE INVENTION

1. Field of the Invention

This invention relates generally to clinching apparatus, and more particularly to a foot-operated press for applying fastener elements such as buttons to garment articles.

2. Prior Art

There have been proposed many different forms of apparatus designed to apply fastener elements such as buttons, rivets, eyelets, ornaments and the like to substrates such as garment fabrics or other sheet materials. A typical example of such apparatus is a press having a punch-and-die assembly and a lever mechanism driven by a foot pedal for actuating a ram which carries a punch, the foot pedal being pressed to provide a downward stroke of the ram thereby driving one of the fastener elements into the other fastener element underlying the substrate on the die. This type of apparatus known in the art is designed such that the foot pedal returns to its initial position immediately upon releasing the operator's foot from the pedal, and consequently the punch ascends regardless of whether or not the two fastener elements have been joined properly together on the substrate. Therefore, it would often happen that a given cycle of attaching the buttons or the like goes unnoticed or unchecked as to completion of the full clinching of the two mating fastener elements.

SUMMARY OF THE INVENTION

It is therefore the primary object of the present invention to provide an improved foot-operated press incorporating structural features which ensure full and complete clinching of fastener elements onto a substrate.

A more specific object of the invention is to provide means in the foot-operated press for preventing the punch from ascending or returning to its start position until after the fastener elements have been fully clinched in place.

The foregoing and other objects of the present invention are attained by a foot-operated press comprising a ratchet mechanism operatively connecting a foot pedal and a punch of the press for preventing backward movement of the foot pedal until after the punch has fully been lowered to ensure that a pair of fastener elements can be assembled together in properly clinched condition, with a garment fabric disposed between the two fastener elements. The ratchet mechanism includes a ratchet wheel rotatably mounted on a fixed shaft and connected to the foot pedal for movement in unison with the foot pedal, a pawl pivotably mounted on a housing secured to the shaft and lockingly engageable with teeth on the rachet wheel to prevent backward movement of the ratchet wheel and hence the foot pedal connected thereto, and a cam disc rotatably mounted in the housing and angularly movable together with the ratchet wheel to bring a cam surface into engagement with the pawl to urge the latter away from the teeth on the ratchet wheel.

Many other advantages and features of the present invention will become manifest to those versed in the art upon making reference to the detailed description and the accompanying sheets of drawings in which a preferred structural embodiment incorporating the principles of the present invention is shown by way of illustrative example. In the drawings, like reference characters refer to like or corresponding parts throughout the several views.

BRIEF DESCRIPTION OF THE DRAWINGS

FIG. is aside elevational view, partly in cross section, of a foot-operated press embodying the present invention.

DETAILED DESCRIPTION

Figure 1:
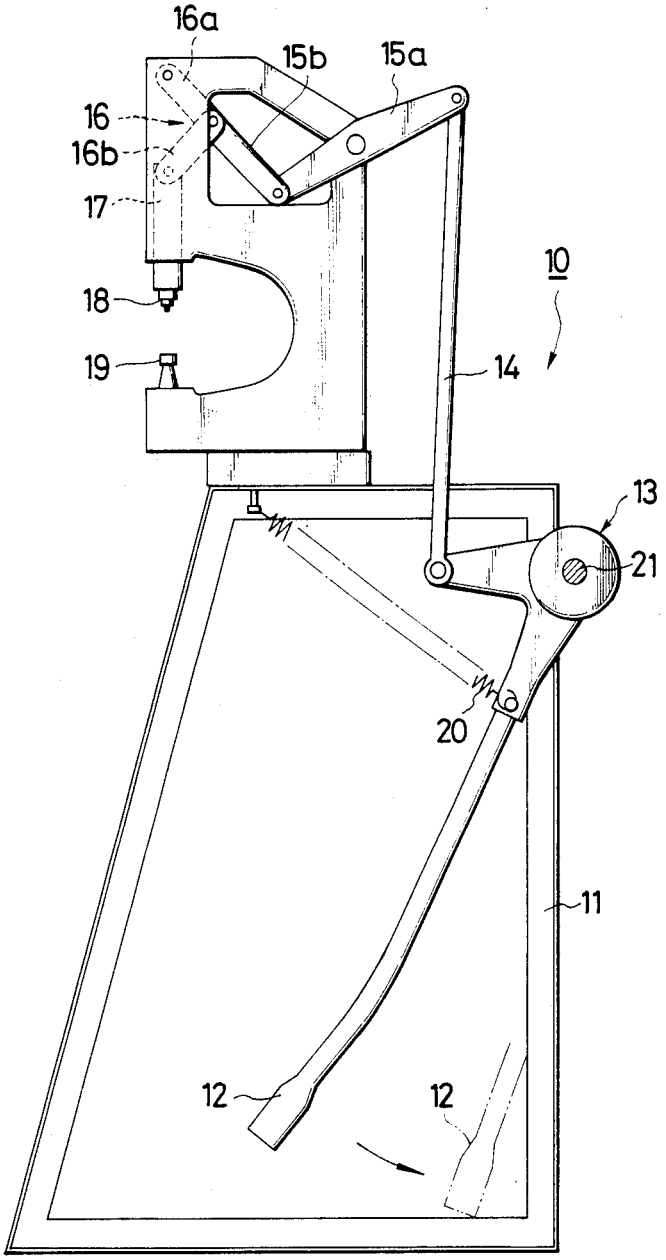

FIG. 1 shows the general construction of a foot-operated press 10 embodying the present invention. The press 10 generally comprises a frame 11, a foot pedal 12 operatively connected via a ratchet mechanism 13 to a connecting rod 14 which is in turn pivotably connected to one end of a pivot lever 15*a* pivoted at its midpoint to the frame 11. The other end of the pivot lever 15*a* is pivotably connected to one end of an actuating lever 15*b*, the other end of which is connected to a pivoted end of a toggle joint 16 composed of a pair of levers 16*a*, 16*b*. The upper lever 16*a* of the toggle joint 16 is pivoted to the frame 11 and the lower lever 16*b*is pivoted to a ram 17. The ram 17 carries a punch 18 which is cooperative with a die 19 in assembling a pair of fastener elements (not shown) in clinched condition, with a substrate such as a garment fabric (not shown) disposed between the two fastener elements. The foot pedal 12 is urged clockwise in FIG. 1 about the ratchet mechanism 13 toward its uppermost standby position by means of a tension spring 20 acting between the frame 11 and the foot pedal 12.

Figure 2:
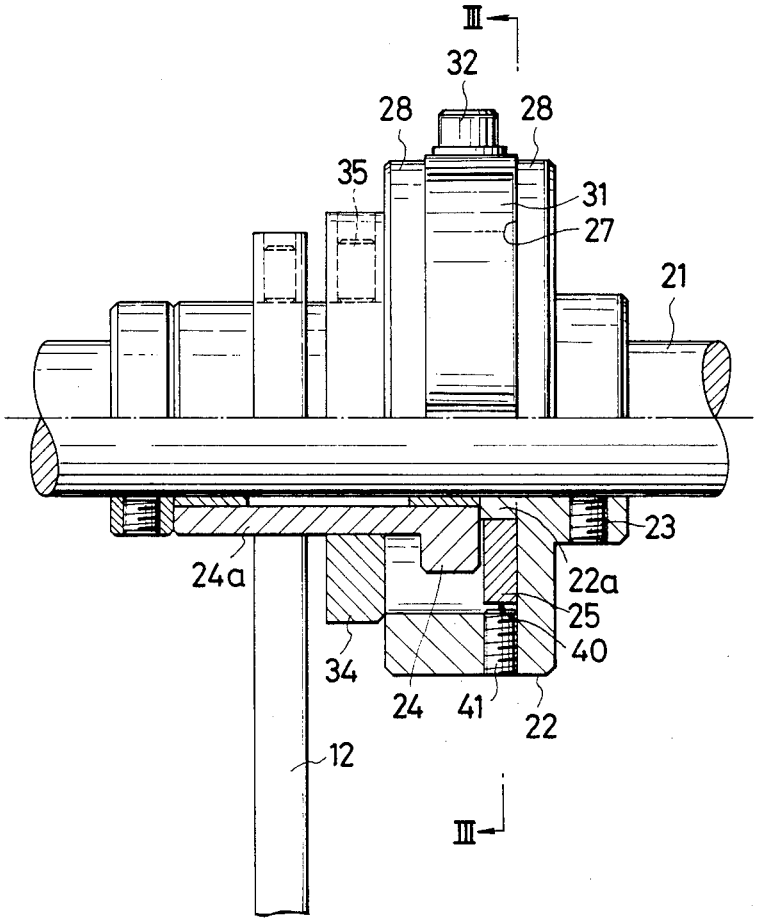
FIG. 2 is an enlarged front elevational view, partly in cross section, of a ratchet mechanism of the press shown in FIG. 1.
Figure 3:
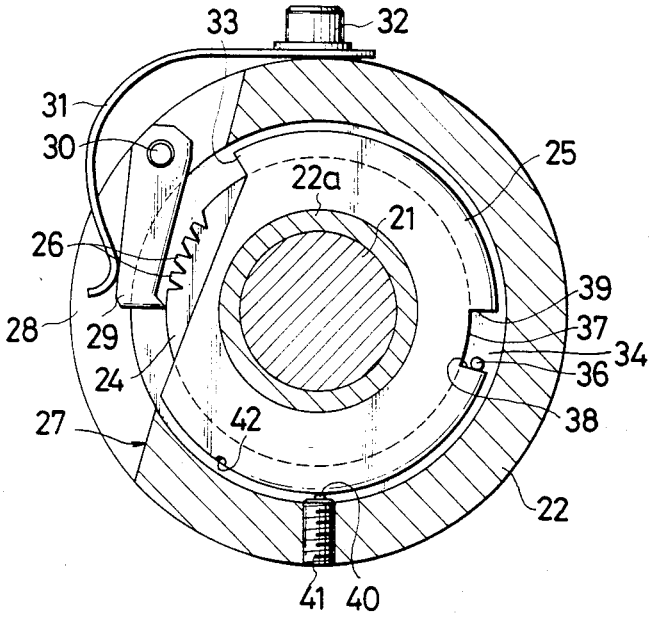
FIG. 3 is a cross-sectional view taken along line III—III of FIG. 2.

The ratchet mechanism 13, as shown in FIGS. 2 and 3, is mounted on a horizontal shaft 21 fixedly secured to the frame 11 and includes a generally cup-shaped housing 22 secured by a screw 23 to the shaft 21, a ratchet wheel 24 rotatably mounted on the shaft 21 and received in the housing 22, and a cam disc 25 disposed between the ratchet wheel 24 and the closed end of the cup-shaped housing 22 and rotatably fitted around a central hub 22*a* of the housing 22 disposed inside the housing 22. The ratchet wheel 24 includes an integral tubular axial extension 24*a* projecting outwardly from the cup-shaped housing 22 and attached by a screw (not designated) to the foot pedal 12 for angular movement around the shaft 21 through a predetermined angular distance together with the foot pedal 12. The ratchet wheel 24 has a series of external teeth 26 on a limited peripheral area disposed in a cut-away peripheral portion 27 defined by a pair of confronting flanges 28 of the housing 22. The ratchet teeth 26 are lockingly engageable with a pawl 29 pivotally connected by a horizontal pin 30 extending between the flanges 28 of the housing 22. The pawl 29 is normally urged toward the ratchet teeth 26 by a leaf spring 31 secured at one end by a screw 32 to the housing 22 between the flanges 28 as shown in FIG. 2. The leaf spring 31 has a width slightly smaller than the distance between the flanges 28 so that the pawl 29 is substantially concealed by the leaf spring 31. The force of the spring 31 is smaller than the force of the spring 20, but by the shape of the ratchet teeth 26 and the pawl 29, upon locking engagement of the pawl 29 with the ratchet teeth 26, the ratchet wheel 24 is automatically prevented from turning in the clockwise direction regardless of the forces of the springs 20, 31.

The length of toothed area of the ratchet wheel 24 is defined between a standby position in which the pawl 29 is disengaged from ratchet teeth 26 and located near the first tooth prior to stepping on the foot pedal 12, and a clinching position in which the pawl 29 is released from the ratchet teeth 26 and disposed adjacent to the last tooth upon completion of clinching by full depression of the foot pedal 12.

The length of the toothed area 26 may be extended to a certain extent in the clockwise direction in FIG. 3. And it is even possible to provide the ratchet teeth 26 around the entire periphery of the ratchet wheel 24, in which instance a shock noise and vibration would be generated when the pawl 29 is brought into locking engagement with the ratchet teeth 26 upon arrival of the foot pedal 12 at its uppermost standby position. It is therefore preferable to leave a non-toothed smooth peripheral portion on the ratchet wheel 24 for smooth contact the pawl 29 when the pedal 12 is returned to its uppermost standby position.

The cam disc 25 is of a generally gibbous shape and has a cam surface 33 engageable with the pawl 29 adjacent to the pin 30 so as to disengage the pawl 29 away from the ratchet teeth 26, for which purpose the pawl 29 has a thickness large enough to extend toward the cam disc 25 beyond the width of the ratchet wheel 24. The cam disc 25 has a maximum outside diameter which is larger than the outside diameter of the ratchet wheel 24.

The ratchet wheel 24 includes a ring member 34 secured by a screw 35 to the axial extension **24*a* of the ratchet wheel 24 for corotation therewith. The ring member 34 is located at a position to substantially close the open end of the cup-shaped housing 22. The ring member 34 has a pin 36 extending axially therefrom and disposed in a cut-away recess 37 which is formed in the outer periphery of the cam disc 25 at a location diagonally opposite to the ratchet teeth 26 as shown in FIG. 3. The cut-away recess 37 is defined between a first end wall 38 and a second end wall 39 of the cam disc 25. The ring member 34 has an outside diameter larger than the outside diameter of the ratchet wheel 24, and the pin 36 is disposed adjacent to the outer periphery of the ring member 34. With this arrangement, only a relatively small force is necessary for turning the cam disc 25 counterclockwise to urge the spring-biased pawl 29 away from the ratchet teeth 26. It is possible however that the pin 36 is provided directly on the ratchet wheel 25 in which instance the cut-away recess 37 extends radially inwardly toward the hub 22*b* of the housing 22. The circumferential extent of the cut-away recess 37 is determined at a proper value depending on the phase of the cam surface 33 on the cam disc 25 and the ratchet teeth 26 on the ratchet wheel 24**.

The ratchet mechanism 13 further includes a detent device composed of a spring-biased stop pin 40 projecting radially inwardly from the inner peripheral wall of the cup-shaped housing 22, and a notch 42 formed in the peripheral surface of the cam disc 25 for snugly receiving the stop pin 40 to temporarily hold the cam disc 25 in position against displacement. The stop pin 40 is axially movably retained in a hollow screw 41 threaded to the peripheral wall of the housing 22.

With this construction, the apparatus 10 performs a cycle of operation depicted in FIG. 3 through FIG. 8. In the first phase of the cycle shown in FIG. 3, the foot pedal 12 is retracted to its uppermost standby position in which the pawl 29 is disengaged from the ratchet teeth 26 and located near the first tooth, the pin 36 is held in abutting engagement with the first end wall 38 of the cam disc 25, and the punch 18 is lifted or retracted to its initial position remote from the die 19.

Figure 4:
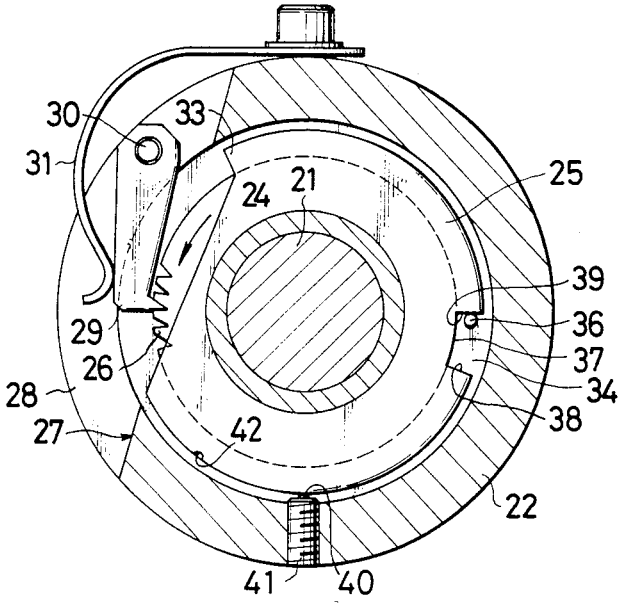
FIGS. 4 through 8 inclusive are views similar to FIG. 3, illustrative of the sequence of operation of the ratchet mechanism.

In the second phase of operation, the foot pedal 12 is depressed to turn the ratchet wheel 24 counterclockwise until the pin 36 reaches the second end wall 39 of the disc 25, in which instance the ram 17 or punch 18 has made a small downward stroke and the pawl 29 has engaged one of the ratchet teeth 26 as shown in FIG. 4. This pawl-to-tooth engagement prohibits reverse or clockwise movement of the ratchet wheel 24 upon release of the pedal 12, which would otherwise occur by the action of the tension spring 20 tending to pull back the pedal 12. In this position, therefore, the operator can ascertain that clinching has not yet begun.

Figure 5:
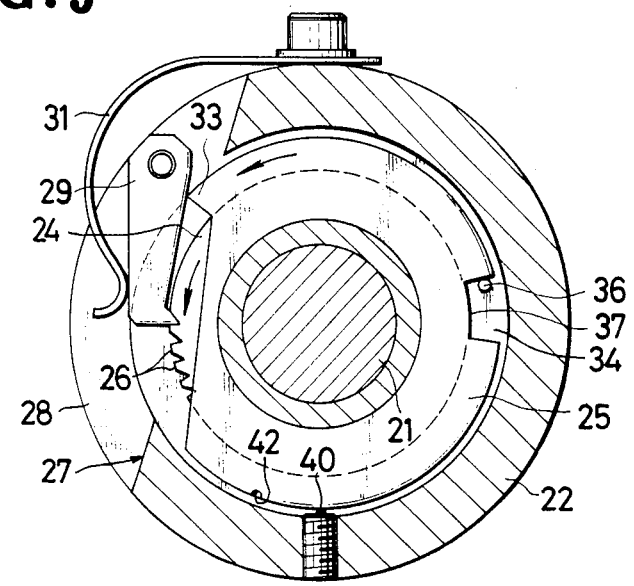

FIG. 5 shows the third phase in which the pedal 12 has been depressed to a further depth thereby continuing counter-clockwise rotation of the ratchet wheel 24 so that the cam disc 25 begins to turn together with the ratchet wheel 24 by the action of the pin 36 until the pawl 29 reaches the last one of the ratchet teeth 26. In this position, the operator can make sure that clinching is still halfway, as the pedal 12 is retained in that position even if the foot is off the pedal 12.

Figure 6:
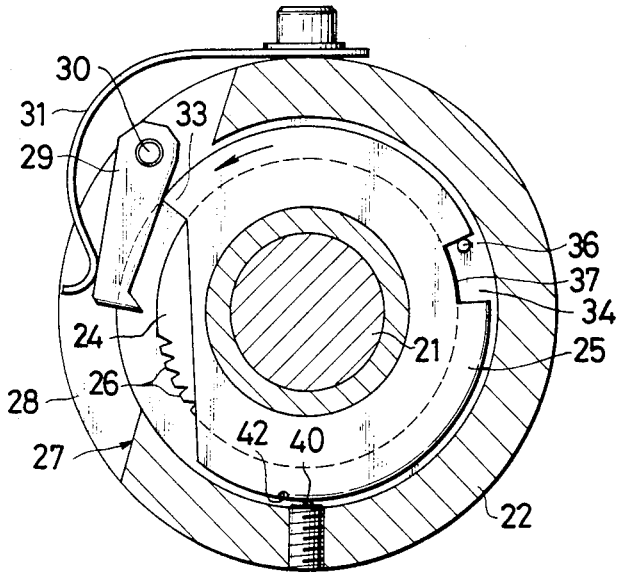

The fourth phase of operation is illustrated in FIG. 6, in which with further rotation of the ratchet wheel 24, the cam surface 33 of the disc 25 abuts against and then urges the pawl 29 to turn clockwise about the pin 30 away from the ratchet teeth 26 against the force of the leaf spring 31. In this position, with the ratchet function terminated, the operator can see to it that fastener elements have been fully clinched together on the substrate as desired.

Figure 7:
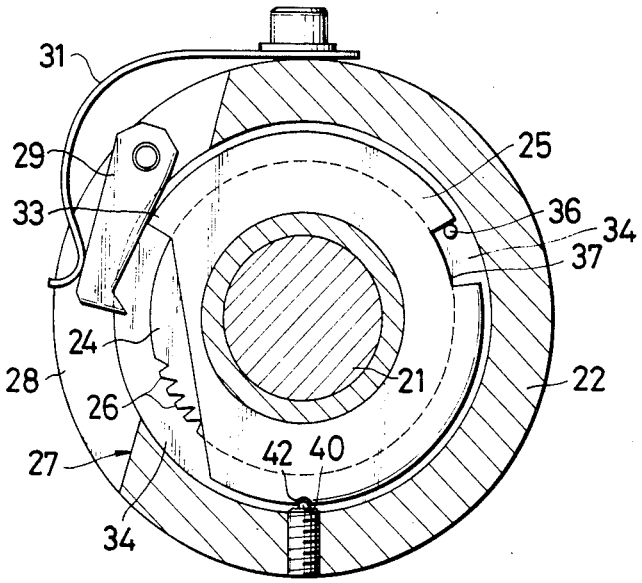

The fifth phase of operation is shown in FIG. 7, in which the pedal 12 is further depressed to bring the stop pin 40 into the notch 42 thereby locking the disc 25 with the housing 22.

Figure 8:
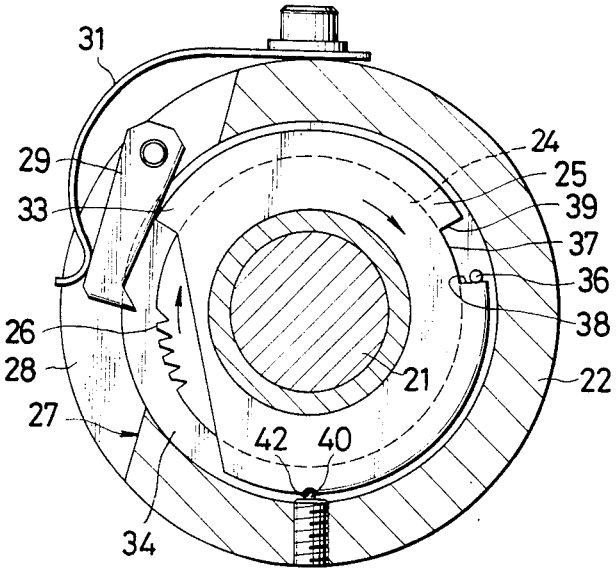

FIG. 8 depicts the sixth or final phase of operation in which releasing the foot pedal 12 allows the ratchet wheel 24 to rotate alone in the clockwise direction under the force of the tension spring 20, thereby shifting the pin 36 from the second end wall 39 back to the first end wall 38 of the cam disc 25 while the cam disc 25 is being held immovable by the detent device 40, 42. Since the foot pedal 12 is continuously urged by the tension spring 20 to turn the ratchet wheel in the clockwise direction, the ratchet wheel 24 and the cam disc 25 are then turned clockwise in unison with each other toward the initial position of FIG. 3.

Obviously, many modifications and variations of the present invention are possible in the light of the above teachings. It is therefore to be understood that within the scope of the appended claims, the invention may be practiced otherwise than as specifically described.

What is claimed is:

1. A foot-operated press comprising:

(a) a frame having a horizontal shaft fixedly secured thereto;

(b) a foot pedal pivotably supported on said frame and angularly movable between an uppermost standby position and a lowermost clinching position, said foot pedal being normally urged toward said standby position;

(c) a punch vertically reciprocably supported on said frame; and (d) a ratchet mechanism mounted on said shaft and operatively interconnecting said foot pedal and said punch, said ratchet mechanism including (i) a housing secured to said shaft, (ii) a ratchet wheel rotatably mounted on said shaft and connected to said foot pedal for movement in unison with said foot pedal, said ratchet wheel having a series of external ratchet teeth disposed in said housing and a pin extending parallel to the axis of said shaft, (iii) a pawl pivotably mounted on said housing and normally urged toward said ratchet wheel, said pawl being lockingly engageable with said ratchet teeth to prevent backward movement of said ratchet wheel and hence said foot pedal connected thereto, and (iv) a cam disc rotatably disposed in said housing and having a recessed portion loosely receiving said pin and engageable with said pin to turn said cam disc together with said ratchet wheel, and further having a cam surface engageable with said pawl to urge the latter away from said ratchet teeth.

2. A foot-operated press according to claim 1, said housing having a generally cup-shape, said cam disc being disposed between said ratchet wheel and a closed end of said cup-shaped housing, said ratchet wheel including an integral tubular axial extension projecting outwardly from said housing and attached to said foot pedal, and a ring member secured to said axial extension at a location to close an open end of said cup-shaped housing, said pin being disposed on said ring member.

3. A foot-operated press according to claim 2, said ring member having an outside diameter larger than the outside diameter of said ratchet wheel, said pin disposed adjacent to the outer periphery of said ring member.

4. A foot-operated press according to claim 1, said housing having a generally cup-shape and including a central hub disposed inside said cup-shaped housing, said cam disc being rotatably fitted around said hub.

5. A foot-operated press according to claim 1, said ratchet teeth being provided on a limited peripheral area of said ratchet wheel and normally held out of engagement with said pawl.

6. A foot-operated press according to claim 1, said housing having a generally cup-shape and including a cut-away peripheral portion and a pair of confronting flanges defining said cut-away peripheral portion, said pawl being disposed in said cut-away peripheral portion.

7. A foot-operated press according to claim 6, including a leaf spring secured at its one end to said housing and acting on said pawl to urge the latter against said ratchet wheel.

8. A foot-operated press according to claim 7, said leaf spring having a width slightly smaller than the distance between said flanges.

9. A foot-operated press according to claim 1, said ratchet mechanism including a detent device for temporarily arresting movement of said cam disc, said detent device comprising a spring-biased pin axially movably mounted on said housing and projecting radially inwardly toward a peripheral surface of said cam disc, and a notch defined in said peripheral surface of said cam disc and snugly receptive of said spring-biased pin.

* * * * *